United States Patent [19]

Sova

[11] Patent Number: 4,894,130

[45] Date of Patent: Jan. 16, 1990

[54] PROCESS FOR ELECTROLYTICALLY DETACHING A PROTECTIVE COATING FROM A BASE METAL SUPERALLOY

[75] Inventor: Vladimir Sova, Remetschwil, Switzerland

[73] Assignee: ASEA Brown Boveri AG, Baden, Switzerland

[21] Appl. No.: 278,467

[22] Filed: Dec. 1, 1988

[30] Foreign Application Priority Data

Dec. 1, 1987 [CH] Switzerland ..... 4673/87

[51] Int. Cl.[4] ..... C25F 5/00

[52] U.S. Cl. ..... 204/129.35; 204/146; 204/129.75; 204/129.95

[58] Field of Search ..... 204/129.35, 146, 129.95, 204/129.75

[56] References Cited

U.S. PATENT DOCUMENTS

| | | | |
|---|---|---|---|
| 2,588,734 | 3/1952 | Kolodney | 204/129.35 |
| 3,015,630 | 1/1962 | Thompson et al. | 252/101 |
| 3,819,494 | 6/1974 | Fountain | 204/146 |
| 4,234,397 | 11/1980 | Torrey | 204/146 X |
| 4,324,626 | 4/1982 | McGivern, Jr. | 204/146 |

FOREIGN PATENT DOCUMENTS

| | | | |
|---|---|---|---|
| 1096709 | 1/1961 | Fed. Rep. of Germany | 204/129.35 |
| 799245 | 8/1958 | United Kingdom | 204/146 |

*Primary Examiner*—Donald R. Valentine

*Attorney, Agent, or Firm*—Oblon, Spivak, McClelland, Maier & Neustadt

[57] ABSTRACT

Process for electrolytically detaching a high chromium and nickel and/or cobalt containing protective coating (7) from a base metal (4) that is made of a nickel-based or cobalt-based superalloy by means of activation in NaOH and HCl and subsequent submersion as the anode into an electrolyte (2), which contains oxidizing components that release oxygen.

In the electrolytic process the chromium-depleted and nickel-enriched diffusion zone (9) of the protective coating (7) is preferably attacked and detached; said zone developing electro-negatively with respect to the surrounding regions.

9 Claims, 3 Drawing Sheets

1/3

2/3

87/109

PROCESS FOR ELECTROLYTICALLY DETACHING A PROTECTIVE COATING FROM A BASE METAL SUPERALLOY

BACKGROUND OF THE INVENTION

1. Field of the Invention

Gas turbines for maximum stress. The critical component is the blade, whereby the protective coatings against erosion, wear, corrosion and oxidation at high temperatures gain in significance. Usually the protective coating has a shorter life span than the core metal of the blade; therefore, the replacement of the former moves more and more into the foreground.

The invention relates to the further development of a process for repairing, maintaining, and replacing components of thermal machines that have protective coatings and have become useless due to erosion, wear, corrosion, oxidation or mechanical damage. In this process the old protective coating has to be removed, which in principle can be achieved by a mechanical or chemical route.

As the reverse process to electroplating, the electrochemical method assumes a special position.

In particular, the invention relates to a process for electrolytically detaching a protective coating having a high Cr and Ni and/or Co content from a base metal of a component that is made of a nickel or cobalt-based superalloy.

2. Discussion of the Background

The removal of protective coatings on substrates that are made of a superalloy is performed, among other methods, by a chemical route. To date electrolytical detachment has not been appreciably used for such alloys. Some methods are known that detach the metals from their substrates by reversing the method of electroplating. It is known from US-A-2 907 700 to remove electrolytically coatings of metals (Ag, Ni, Cd, Zn, In) from a plutonium substrate. Sulfuric acid or a sodium phosphate solution is used as the electrolyte. An electrolytic process is known from DE-B 21 46 828 for detaching metal coatings (Cr, Au, Cd, Cu, Ag, Zn, Sn, Ni) from stainless Cr/Ni steel. Bromine-containing solutions of nitrates, acetates, chlorides etc. are used as the electrolyte. Apparently the attack on the substrate is negligible, According to DE-C-25 27 152 coatings of metals (Ni, Cr, Zn, Sn, Cu, Cd, Ag) are to be removed electrolytically from steel by using nitric acid or nitrate-containing solutions that contain iodine as the electrolyte, to which additional organic chlorine compounds are added.

These known methods, which are based on the fact that the detaching potential of the metal coating is adequately different from that of the substrate, cannot in the current form be transferred to protective coatings on nickel-based superalloys. The close relationship of the chemical composition between the protective coating and the substrate usually makes it impossible to electrolytically detach the latter without simultaneously attacking the substrate in an inadmissible manner. Not even falling back upon complex-forming additions to the electrolyte provides a remedial measure.

Furthermore, in the case of components that are made of a superalloy (gas turbine blade) the conditions for non-aggression with respect to the substrate is much more rigorous than for any other, e.g. aforementioned, objects. Only in a few cases could a gas turbine blade whose core metal is modified even only slightly be reused.

Therefore, there is a strong need to eliminate largely the aforementioned deficiencies and to specify means for the successful application of an electrolytic process to detach protective coatings applied on nickel-based or cobalt based superalloys.

SUMMARY OF THE INVENTION

The technical problem on which the invention is based is to provide a process to detach a protective coating, based on a nickel and/or cobalt alloy with a high chromium content, of a base metal of a component that is made of a chromium-containing nickel and/or cobalt-based alloy. In this process the coating is to be completely removed without attacking, wearing off or damaging the material of the base metal, or without impairing or modifying its chemical-physical properties and its behavior with respect to compatibility, in particular when the protective coating is subsequently reapplied (recoated).

The problem is solved by the invention in that in the aforementioned process the component to be coated with a protective coating is submerged for activation into a solution of 20% NaOH and then at 40° C. for 2 hours into such a solution of concentrated HCl that the component with its activated coating is introduced as an anode into an electrolyte that contains oxygen-releasing, oxidizing components and is subjected to electrolysis until the coating is completely detached and drops off.

BRIEF DESCRIPTION OF THE DRAWINGS

The invention is described with the aid of the following embodiments that are explained in detail by means of the Figures.

DETAILED DESCRIPTION OF THE PREFERRED EMBODIMENTS

Figure 1:
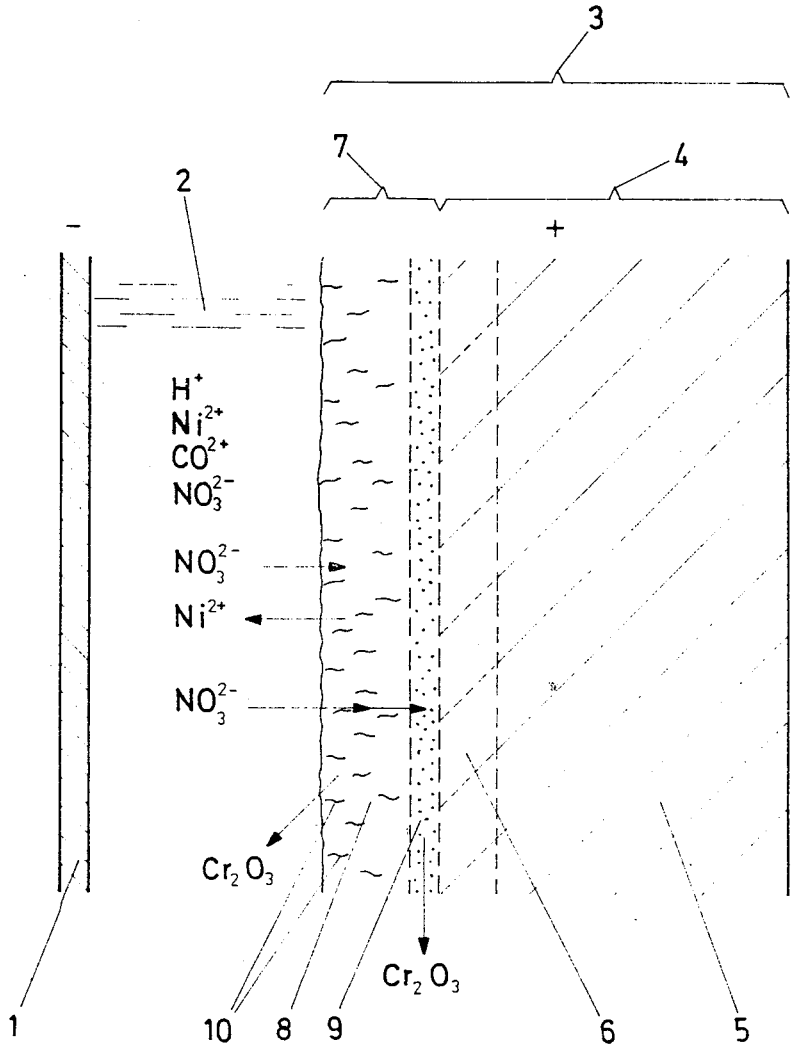
FIG. 1 is a schematic cross-sectional view of an active part of an electrolytic cell for implementing the invention.

FIG. 1 is a schematic cross-sectional view of the active part of an electrolytic cell for implementing the process. The non-essential parts that in principle do not play an active part in the process such as vessel, power supply, clamps, agitator, controller, etc. have been omitted for the sake of a better overview. 1 is the cathode (usually sheet metal made of corrosion-resistant Cr/Ni steel), 2 is the electrolyte (indicated by horizontal dashes), 3 is the anode comprising a base metal and the protective coating. The base metal (substrate) 4 is made of a nickel-based or cobalt-based superalloy, which is normally present primarily as the unmodified part 5 (core material). A diffusion zone 6 in the base metal 4 is at the interface of the coating 7.

The protective coating 7 in turn comprises an originally non-modified part 8 and a diffusion zone 9. Usually the latter forms after the coating 7 is applied by means of diffusion annealing during fabrication; however at the latest, said zone forms upon reaching high temperatures during operation. As a rule said zone is characterized by a depletion of chromium and enrichment of nickel. In the electrolyte 2, the ions ($H^+$; $Ni^{2+}$, $Co^{2+}$, $NO_3^{2-}$), which are present primarily in the present example, are indicated. The electro-chemical attack occurs first on the surface of the coating 7 by means of $NO_3^{2-}$ ions, which primarily leach out the nickel (indicated by means of the arrows marked $NO_3^{2-}$ and $Ni^{2+}$). In this manner the coating 7 is loosened, which is indicated by the formation of pores 10. In this manner the attack of the electrolyte advances constantly deeper into the interior of the protective coating 7. The chromium is oxidized primarily by means of the oxidizing attack and acts passivatingly. The $Cr_2O_3$ particles that are formed drop off successively from the loosened bond by mechanical means (indicated by means of the arrow). Then preferably the chromium-depleted and nickel-enriched diffusion zone 9 of the protective coating 7 that electrochemically behaves negatively with respect to the neighboring regions is attacked in that the chromium is oxidized and drops off mechanically as $Cr_2O_3$ (indicated by the arrow).

Figure 2:
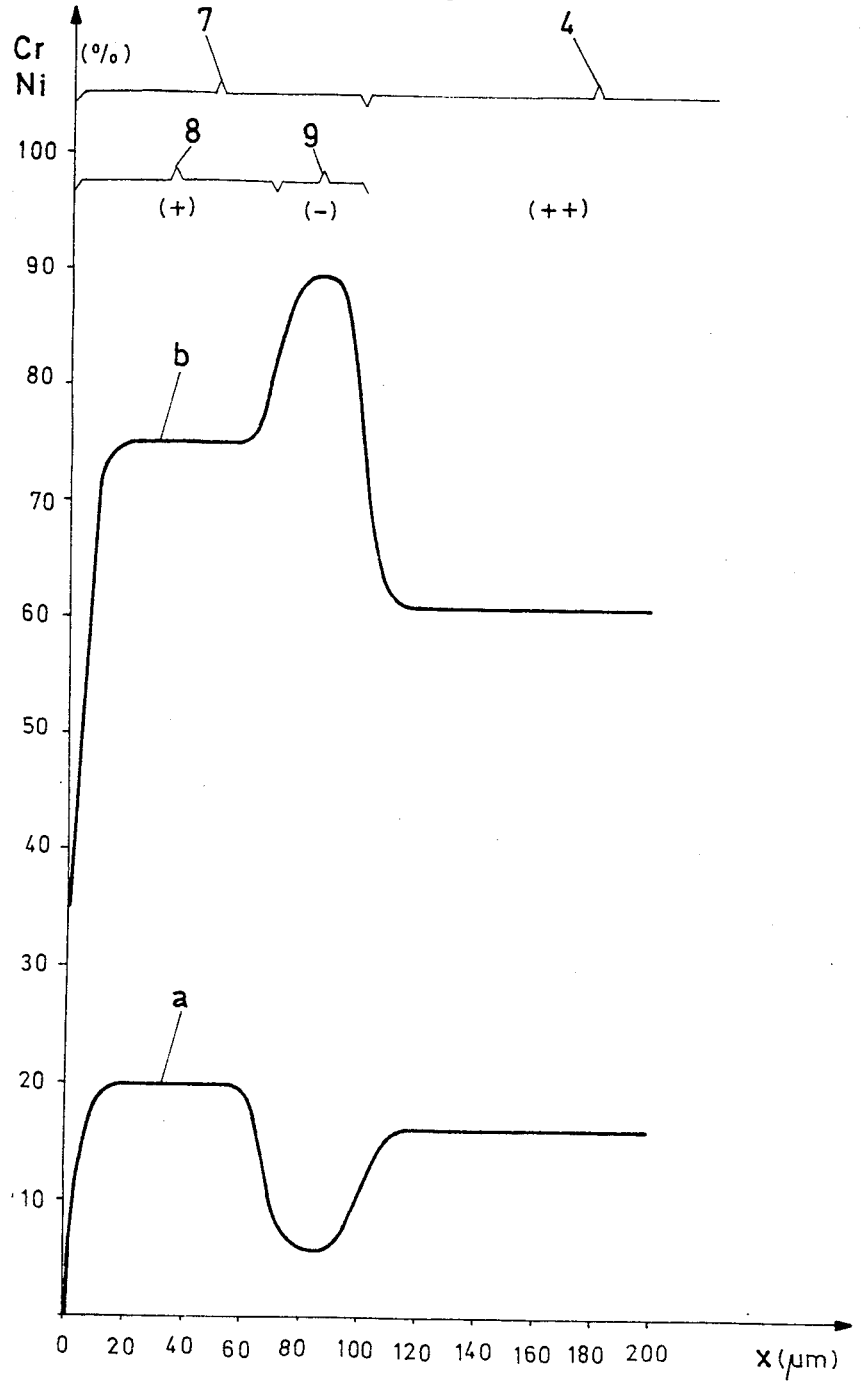
FIG. 2 is a highly schematized graph showing the curve of the Cr- and Ni content in the protective coating and the sub-region of the base metal.

FIG. 2 shows the highly schematized curve of the chromium and nickel content in the protective coating and the subregion of the base metal. The depth, measured from the surface in μm, is plotted on the abscissa x; the abscissa shows the Cr or Ni content in % by weight. 4 is the base metal which behaves most efficaceously electropositively (indicated by means of ++); 7 is the protective layer, whose original non-modified part 8 develops electro-positively, yet not as high as the base metal 4 under the conditions of electrolysis (indicated by +).

With respect to its neighboring regions, the diffusion zone 9 of the protective coating 7 develops electro-negatively (indicated by −). Curve "a" shows the course of the chromium content; curve "b" shows that of the nickel content as a function of the depth x. The values are highly schematized averages of numerous samples. The curve can assume quantitatively other values; however, in principle it always shows the same picture of chromium depletion and Ni enrichment in the diffusion zone 9.

Figure 3:
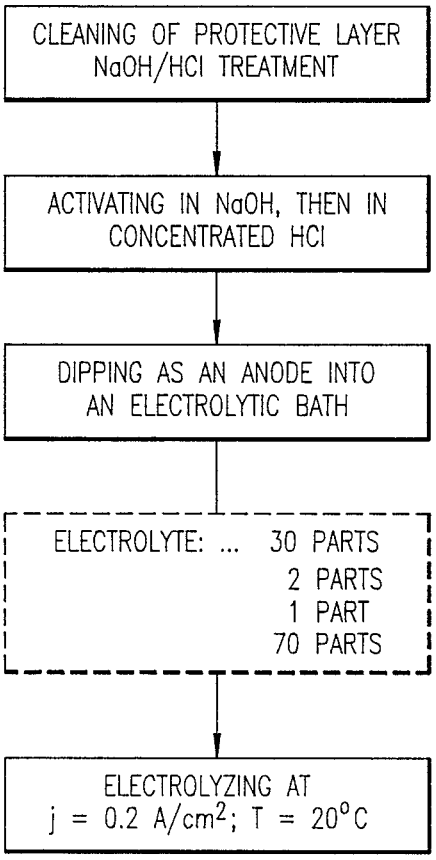
FIG. 3 is a flow chart (block diagram) of a configuration of the process.

FIG. 3 is a flow diagram in the form of a block diagram of a possible embodiment of the process. The diagram is self-explanatory and needs no further explanations.

Electrolytic separating processes are based on the difference between the separating or detaching potential of the participating components and/or phases. In the present case the potentials of the base metal (substrate) 4 and the protective coating 7 are usually very close, since they are nickel alloys with chromium contents that do not deviate from one another significantly. Thus, at first it does not seem possible to detach the protective coating 7 without simultaneously attacking the base metal 4 since it involves the same ions. However, it could be demonstrated that even in the case of closely related alloys for the protective coating and the base metal the concentrations and potentials differ significantly by means of diffusion when the coated components are heat treated. By means of interdiffusion an interface (diffusion zone 9) forms which (in an oxidizing electrolytic bath) assumes a negative electro-chemical potential with respect to the environment and consequently is more readily attacked and detached.

EXAMPLES

Embodiment 1

A gas turbine blade whose top end is partially damaged and which has a protective coating has the following dimensions for the blade:

| | |
|---|---|
| length = | 175 mm |
| maximum width = | 90 mm |
| maximum thickness = | 23 mm |
| profile height = | 28 mm |

The core material of the gas turbine blade comprised a nickel-based wrought alloy with the trade name Nimonic 80A of the following composition:

| | | |
|---|---|---|
| Cr = | 19.5 | % by weight |
| Al = | 1.4 | % by weight |
| Ti = | 2.4 | % by weight |
| Zn = | 0.06 | % by weight |
| Mn = | 0.30 | % by weight |
| Si = | 0.30 | % by weight |
| B = | 0.003 | % by weight |
| C = | 0.06 | % by weight |
| Ni = | remainder | |

The protective coating whose thickness ranges from 100 to 150 μm had been applied by means of plasma spraying on the core metal and had the following composition:

| | | |
|---|---|---|
| Cr = | 17 | % by weight |
| Si = | 4.5 | % by weight |
| Fe = | 4.5 | % by weight |
| B = | 3.5 | % by weight |
| Ni = | remainder | |

The gas turbine blade was cleaned by placing it into a solution of 20% NaOH at a temperature of 100° C. for 2 hours and then it was subsequently treated in concentrated HCl. Then the blade was brushed with a steel brush.

After the cleaning, the blade was activated. For this purpose it was once again introduced into a 20% NaOH and then placed into concentrated HCl for 2 hours.

The cleaned and activated blade was suspended as the anode into an electrolytic bath. The electrolyte had the following composition:

| | | |
|---|---|---|
| 30 | parts concentrated | $HNO_3$ |
| 2 | parts | $Ni(NO_3)_2$ |
| 1 | part | $Co(NO_3)_2$ |
| 70 | parts | $H_2O$ |

Sheet metal made of corrosion-resistant 18 Cr/B nickel steel served as the cathode.

At this point electrolysis was performed for 144 hours under a cell voltage of 1,000 mV at an anodic current density of 0.2 A/dm$^2$. In this case the bath temperature was 25° C. Following this treatment the blade was removed from the bath, rinsed, brushed and dried.

Embodiment 2

A gas turbine blade whose protective coating was worn off over a large part of its blade and having the following dimensions:

| | |
|---|---|
| length = | 180 mm |
| maximum width = | 93 mm |
| maximum thickness = | 22 mm |
| profile height = | 29 mm |

was subjected to an electrolytic treatment to remove the remaining protective coating. The core material had the trade name IN 939 from INCO, was a nickel-based, cast superalloy and had the following composition:

| | | |
|---|---|---|
| Cr = | 22.4 | % by weight |
| Co = | 19.0 | % by weight |
| Ta = | 1.4 | % by weight |
| Nb = | 1.0 | % by weight |
| Al = | 1.9 | % by weight |
| Ti = | 3.7 | % by weight |
| Zr = | 0.1 | % by weight |
| C = | 0.15 | % by weight |
| Ni = | remainder | |

The protective coating whose thickness measured on average approximately 120 μm had the following composition:

| | | |
|---|---|---|
| Cr = | 49 | % by weight |
| Si = | 6 | % by weight |
| Fe = | 2 | % by weight |
| Ni = | remainder | |

First, the gas turbine blade was cleaned, brushed, and activated as stipulated in example 1. Then the blade was suspended as the anode into an electrolytic bath. The electrolyte had the following composition:

| | | |
|---|---|---|
| 10 | parts concentrated | $HNO_3$ |
| 5 | parts | $AgNO_3$ |
| 90 | parts | $H_2O$ |

Sheet metal made of corrosion-resistant Cr-Ni steel served as the cathode. The protective coating was detached by means of electrolysis under a cell voltage of 1,100 mV at an anodic current density of 0.2 A/dm$^2$ for 120 hours. The bath temperature was 20° C.

Embodiment 3

A gas turbine blade, whose top end was severely damaged and which had a protective coating, had to be freed of its protective coating prior to repairs. The dimensions of the blade were the same as in example 1. The core material of the blade was made of a nickel-based, cast superalloy having the trade name IN 738 from INCO and the following composition:

| | | |
|---|---|---|
| Cr = | 16.0 | % by weight |
| Co = | 8.5 | % by weight |
| Mo = | 1.75 | % by weight |
| W = | 2.6 | % by weight |
| Ta = | 1.75 | % by weight |
| Nb = | 0.9 | % by weight |
| Al = | 3.4 | % by weight |
| Ti = | 3.4 | % by weight |
| Zr = | 0.1 | % by weight |
| B = | 0.01 | % by weight |
| C = | 0.11 | % by weight |
| Ni = | remainder | |

The protective coating had an average thickness of 100 μm and had the following composition:

| | | |
|---|---|---|
| Cr = | 20 | % by weight |
| Fe = | 2 | % by weight |
| B = | 3 | % by weight |
| Ni = | remainder | |

The gas turbine blade was cleaned and activated as stipulated in example 1. Then it was introduced into an electro-chemical cell and subjected to an electrolytic process. The electrolyte had the following composition:

| | | |
|---|---|---|
| 20 | parts | $CrO_3$ |
| 80 | parts | $H_2O$ |

As in example 1, sheet metal that was made of corrosion-resistant 18/8 steel served as the cathode. The cell voltage was 1,050 mV; the current density at the anode was 0.2 A/dm$^2$. Electrolysis was performed for 140 hours at a bath temperature of 22° C.

Embodiment 4

The core material of a gas turbine blade having the same dimensions as the blade specified in example 2 was made of a a nickel-based, wrought superalloy having the trade name IN 105 from INCO and having the following composition:

| | | |
|---|---|---|
| Cr = | 13.5 | % by weight |
| Co = | 18 | % by weight |
| Al = | 4.2 | % by weight |
| Mo = | 4.5 | % by weight |
| Ti = | 0.9 | % by weight |
| Mn = | 1 | % by weight |
| Si = | 1 | % by weight |
| C = | 0.2 | % by weight |
| Ni = | remainder | |

The protective coating had a thickness on average of 140 μm and had the following composition:

| | | |
|---|---|---|
| Cr = | 10 | % by weight |
| Si = | 6 | % by weight |
| Fe = | 4 | % by weight |
| CO = | 20 | % by weight |
| Ni = | remainder | |

After the component had been cleaned and activated as in example 1, it was suspended as the anode into an electrolytic bath.

| | | |
|---|---|---|
| 10 | parts | $H_2SO_4$ |
| 10 | parts | $Na_2S_2O_8$ |
| 80 | parts | $H_2O$ |

Sheet metal that was made of corrosion-resistant 18 Cr/8 Ni steel served as the cathode.

Electrolysis was performed under a cell voltage of 1,100 mV at an anodic current density of 0.18 A/dm$^2$ for 150 hours. The bath temperature was 24° C. Following the treatment, the component was rinsed, brushed, and dried in the conventional manner.

Embodiment 5

A gas turbine blade, which was partially damaged by a combination of erosion and corrosion and which had a protective coating, was cleaned and activated according to example 1. The blade had the same dimensions as in example 1. The core material was made of a nickel-based, cast superalloy having the trade name IN 738. See above for the composition. The protective coating had a thickness of 150 μm and its composition corresponded to that in example 1.

After the component had been cleaned and activated as stipulated in example 1, it was suspended as the anode into an electrolytic bath. The electrolyte had the following composition:

| | |
|---|---|
| 30 parts | $HNO_3$ |
| 70 parts | $H_2O$ |
| 10 g/l | $AgNO_3$ |
| 20 g/l | $NH_4HF_2$ |

A sheet metal that was made of corrosion-resistant 18/8 steel served as the cathode. At this point electrolysis was performed under a cell voltage of 1,100 mV at an anodic current density of 0.2 A/dm$^2$. Every 20 minutes the cell voltage was increased to 2,800 mV for 15 sec. (additional transient voltage of 1,700 mV based on the stationary value of the cell). This led to a faster removal of the insoluble oxides of the respective active surfaces of the still remaining protective coating. In this manner a new electrolyte was periodically introduced to the surface. Following an operating period of 60 hours in total, the protective coating was completely removed without the base metal having been attacked. The time for detaching the protective coating can be reduced by 40 to 70% by means of this pulsed process of the cell voltage.

The invention is not limited to the embodiments. The process relates in particular to electrolytically detaching protective coatings that have a high chromium content and a high nickel or cobalt content or simultaneously high nickel and cobalt content. Thus it involves high chromium-containing nickel or cobalt-based alloys or such that are based on a mixture comprising nickel and cobalt. The activation occurs by means of 20% NaOH and subsequent placing into concentrated HCl for 2 hours at 40° C. Then the component is placed as the anode into an electrolyte that contains oxidizing components that release oxygen. There said component is subjected to electrolysis until the protective coating detaches completely and falls off. The protective layer may be pre-treated by means of grinding and/or sandblasting or shot peening prior to the electrolysis. In stubborn cases the work is done with pulsed cell voltage. At each interval of 10 to 30 min. for 5 to 10 sec., a transient voltage of 1,500 to 2,000 mV, in addition to the cell voltage, is intermittently overlaid the steady cell voltage.

I claim:

1. A process for electrolytically removing a high chromium and nickel-containing or cobalt-containing protective coating from a nickel-based or cobalt-based superalloy base metal component having said protective coating, comprising the steps of:

(i) submerging the component having said protective coating in a solution of 20% NaOH, thereby activating said component;

(ii) submerging the activated component in concentrated HCl for 2 hours;

(iii) placing the component from step (ii) as the anode into an electrolytic cell, said cell containing an electrolyte which contains an oxidizing component which releases oxygen; and (iv) subjecting the anode component to electrolysis to remove said protective coating.

2. The process of claim 1, wherein the electrolyte has the following composition:

| | | |
|---|---|---|
| 30 parts | concentrated | $HNO_3$ |
| 2 parts | | $Ni(NO_3)_2$ |
| 1 part | | $Co(NO_3)_2$ |
| 70 parts | | $H_2O$. |

3. The process of claim 1, wherein the protective coating is preteated by means of grinding or sandblasting or shot peening prior to placing said component in the electrolyte and wherein said electrolyte has the following composition:

| | | |
|---|---|---|
| 10 parts | concentrated | $HNO_3$ |
| 5 parts | | $AgNO_3$ |
| 90 parts | | $H_2O$. |

4. The process of claim 1, wherein the electrolyte has the following composition:

| | |
|---|---|
| 20 parts | $CrO_3$ |
| 80 parts | $H_2O$. |

5. The process of claim 1, wherein the electrolyte has the following composition:

| | |
|---|---|
| 10 parts | $H_2SO_4$ |
| 10 parts | $Na_2S_2O_8$ |
| 80 parts | $H_2O$. |

6. The process of claim 1, wherein the electrolyte has the following composition:

| | |
|---|---|
| 30 parts | $HNO_3$ |
| 70 parts | $H_2O$ |
| 10 g/l | $AgNO_3$ |
| 20 g/l | $NH_4HF_2$. |

7. The process of claim 1, wherein during said electrolysis an additional transient voltage of 1,500 to 2,000 mV is intermittently overlaid the steady cell voltage at intervals of 10 to 30 min. for 5 to 10 sec. each.

8. The process of claim 1, wherein said oxidizing component is selected from the group consisting of $HNO_3$, $CrO_3$ and $H_2SO_4$.

9. The process of claim 1, wherein step (ii) is conducted at 40° C.

* * * * *